US007410386B2

(12) United States Patent
Fabian et al.

(10) Patent No.: US 7,410,386 B2
(45) Date of Patent: Aug. 12, 2008

(54) PLUGGABLE SCREWLESS WIRE CONNECTOR SYSTEM

(75) Inventors: David James Fabian, Mount Joy, PA (US); John Michael Landis, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 11/643,428

(22) Filed: Dec. 21, 2006

(65) Prior Publication Data

US 2007/0099480 A1 May 3, 2007

Related U.S. Application Data

(63) Continuation-in-part of application No. 11/071,133, filed on Mar. 3, 2005, now Pat. No. 7,297,019.

(51) Int. Cl.
*H01R 4/26* (2006.01)
*H01R 3/00* (2006.01)

(52) U.S. Cl. ..... 439/441; 439/491

(58) Field of Classification Search ..... 439/438–441, 439/489–491

See application file for complete search history.

(56) References Cited

U.S. PATENT DOCUMENTS 3,067,403 A 12/1962 Kulka
3,324,447 A * 6/1967 Pistey ..... 439/441
3,945,706 A 3/1976 Steiner et al.
4,443,048 A 4/1984 Moist, Jr.
4,544,220 A 10/1985 Aiello et al.
4,564,252 A 1/1986 Kato et al.
4,566,748 A * 1/1986 Tanishi et al. ..... 439/441
4,580,863 A * 4/1986 Lohr et al. ..... 439/695
4,704,091 A 11/1987 Owens et al.
4,787,864 A 11/1988 Hunt, III et al.
4,824,395 A * 4/1989 Blaha ..... 439/438
5,181,865 A 1/1993 Hayes, Sr.
5,211,583 A 5/1993 Endo et al.
5,273,443 A 12/1993 Frantz et al.
5,454,730 A * 10/1995 Tozuka ..... 439/438

(Continued)

FOREIGN PATENT DOCUMENTS

JP 2000 164286 6/2000

(Continued)

OTHER PUBLICATIONS

AMP, Soft Shell Pin and Socket Connectors, Catalog 82181, Revised Jun. 1998, 94 pgs.

(Continued)

*Primary Examiner*—Briggitte R Hammond

(57) ABSTRACT

According to an aspect of the present disclosure, a connector assembly for terminating a plurality of discrete wires and for selective electrical interconnection with a header assembly is provided. The connector assembly includes a front housing defining at least one channel therein; a rear housing selectively operatively connectable to the front housing, the rear housing including at least one passage formed therein and in operative association with a respective channel of the front housing, each passage terminating a respective discrete wire; and at least one contact disposed at least partially within each channel of the front housing and each corresponding passage of the rear housing. Each contact is configured and adapted to define a poke-in connection.

21 Claims, 10 Drawing Sheets

U.S. PATENT DOCUMENTS

| | | | | |
|---|---|---|---|---|
| 5,643,009 | A | 7/1997 | Dinkel et al. | |
| 5,741,153 | A | 4/1998 | Schwer | |
| 5,775,935 | A | 7/1998 | Barna | |
| 5,924,890 | A | 7/1999 | Morin et al. | |
| 5,975,940 | A * | 11/1999 | Hartmann et al. | 439/441 |
| 6,254,422 | B1 * | 7/2001 | Feye-Hohmann | 439/441 |
| 6,280,233 | B1 * | 8/2001 | Beege et al. | 439/441 |
| 6,514,098 | B2 | 2/2003 | Marpoe, Jr. et al. | |
| 6,746,286 | B2 * | 6/2004 | Blaha | 439/787 |
| 6,896,538 | B2 | 5/2005 | Grubbs | |
| 6,923,675 | B2 | 8/2005 | Gorin | |
| 6,981,890 | B2 * | 1/2006 | Cutler et al. | 439/441 |
| 2006/0199424 | A1 | 9/2006 | Landis et al. | |

FOREIGN PATENT DOCUMENTS

| | | |
|---|---|---|
| JP | 2003 059577 | 2/2003 |

OTHER PUBLICATIONS

International Search Report PCT/US2007/025870 dated Jun. 17, 2008.

* cited by examiner

PLUGGABLE SCREWLESS WIRE CONNECTOR SYSTEM

CROSS REFERENCE TO RELATED APPLICATION

The present application is a Continuation-in-Part Application which claims the benefit of and priority to U.S. application Ser. No. 11/071,133, filed on Mar. 3, 2005 now U.S. Pat. No. 7,297,019, the entire content of which is incorporated herein by reference.

BACKGROUND

1. Technical Field

The present disclosure relates to the field of electrical connector assemblies and header assemblies and, more particularly to connector systems including improved connector assemblies facilitating the connection of wires thereto and improved header assemblies configured and dimensioned to mate with multiple connector assemblies simultaneously.

2. Background of Related Art

Pin and socket connectors of the type sold under the tradename MATE-N-LOK® by AMP Incorporated have pin or socket contacts therein which are used to terminate wires coaxially crimped thereto. The contacts are situated in cavities through a housing constructed for mated connection with a complementary housing of another connector or header assembly.

Connector assemblies typically include a housing having cavities therethrough which receive the mating portions of respective contacts, with or without a retainer with passages therethrough which are assembled over respective wires. The retainer is operatively engaged to the rearward face of the housing to retain the contacts therein. Each wire must be electrically connected to the proper corresponding contact of the connector assembly in order to establish the correct electrical connection and not to short-out the system.

Typically each connector assembly mates with a corresponding header assembly. In other words, for each connector assembly there is a corresponding individual complementary header assembly configured and dimensioned to selectively receive and/or mate with the header assembly. As such, numerous header assemblies are employed to accommodate each and every connector assembly.

Electrical terminals are well known in the connector industry. Typically, the terminals include a pin and mating socket, together with a conductor connecting portion. In the event that the terminals are connected to wires, the terminals include a wire connecting section. One such form of wire connecting section is the wire crimp, where the wire is stripped and placed in a terminal end, and then crimped in place where the metal deforms about the conductor to form the electrical connection.

It is desirable in certain applications to not require a crimped connection. Typically, this is in the situation where the wires are stripped on site, and where crimping tools are not readily available. An example of such a situation would be in the lighting industry where overhead lights are installed, and it is easier for the installer to not require a crimped connection.

Currently, electrical wires are attached to plug-in connectors by inserting an end of the wire into an opening of the connector where the wire is engaged by a force to hold or lock the wire into place. Particularly desirable is a poke-in connector, wherein an insulated wire, particularly a wire having a portion of the insulation removed, is inserted into a connector and the connector engages the wire therein. This engagement of the wire may be by a lance, tab, spring or other tensioning mechanism within the connector.

According, a need exists for connector assemblies including poke-in style termination in a connector assembly The need exists for connector assemblies which provided the user with improved visual indication as to which wire is to be electrically connected to a particular contact.

The need also exists for a header assembly configured and dimensioned to selectively mate with and/or accommodate a multiplicity of connector assemblies simultaneously.

SUMMARY

The present disclosure relates generally to the field of electrical connector assemblies and header assemblies.

According to an aspect of the present disclosure, a connector assembly for terminating a plurality of discrete wires and for selective electrical interconnection with a header assembly is provided. The connector assembly includes a front housing defining at least one channel therein and including at least one passage to accept a separable contact lead. The front housing includes a front end portion and a rear end portion, wherein the front end portion of the front housing defines a cavity formed in a front face thereof.

The connector assembly further includes a rear housing selectively operatively connectable to the front housing. The rear housing including at least one passage formed therein and in operative association with a respective channel of the front housing, wherein each passage terminates a respective discrete wire. The rear housing includes a front end portion and a rear end portion, wherein the rear end portion of the rear housing is configured and dimensioned for insertion into the cavity of the front housing.

The connector assembly further includes at least one contact disposed at least partially within each channel of the front housing and each corresponding passage of the rear housing. Each contact is configured and adapted to define a poke-in connection.

Each contact may include a wire trap arm having a distal end extending into the respective passage of the rear housing. Each wire trap arm may be angled away from a rear surface of the rear housing. Each wire trap arm may be deflectable towards a distal surface of the front housing.

Each wire trap arm may be deflectable upon insertion of a wire into the respective passage of the rear housing, and wherein withdrawal of said wire from the respective passage results in a distal tip of the wire trap arm digging into the wire. Each wire trap arm may be deflectable from a first position in which the distal end thereof extends into the respective passage of the rear housing, and a second position in which said wire trap arm is deflected toward a distal surface of the front housing.

The connector assembly may further include a visual coding system provided on a surface of at least one of the front housing and the rear housing. The visual coding system may include unique indicia for each passage of the rear housing.

The indicia may be a set of color codes. The visual coding system may be provided on a rear surface of the rear housing. The visual coding system may include a label having all of the indicia produced thereon. The label may be affixed to the rear surface of the rear housing.

The passages provided in the rear housing may be arranged into an upper row of passages and a lower row of passages. The label may be affixed between the upper row of passages and the lower row of passages.

The connector assembly may further include a latch arm operatively connected to an upper surface of the rear housing. The latch arm may operatively engage a detent provided on a surface of a header assembly or with a complementary connector assembly.

The front housing may include at least one polarization member configured and dimensioned to operatively engage a complementary polarization element provided in a receptacle of the header assembly. The rear housing may snap-fit engage with the front housing.

The cavity formed in the front surface of the front housing may have a first dimensional height, and the rear end portion of the rear housing may have a second dimensional height that is less than the first dimensional height of the cavity.

Each contact may be a tuning fork-type contact to accept blade or pin-type leads on one end thereof and wire trap arm on another end thereof. The wire trap arm of each contact may extend into at least one of a respective path of the passage of the rear housing and a respective path of the channel of the front housing. Each contact may be captured between the front housing and the rear housing when the front and rear housings are coupled to one another.

The front housing and rear housing may be fabricated from a thermoplastic material. Each contact may be fabricated from at least one of phosphor bronze and brass.

For a better understanding of the present disclosure and to show how it may be carried into effect, reference will now be made by way of example to the accompanying drawings.

DETALIED DESCRIPTION OF THE DRAWINGS

DETAILED DESCRIPTION OF THE EMBODIMENTS

Figure 1:
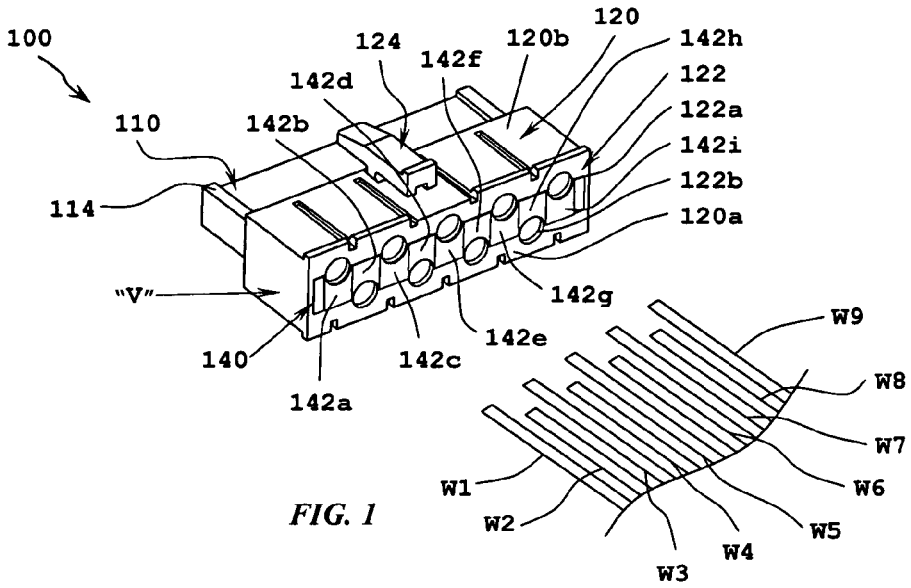
FIG. 1 is a perspective view of a connector assembly according to an embodiment of the present disclosure.
Figure 2:
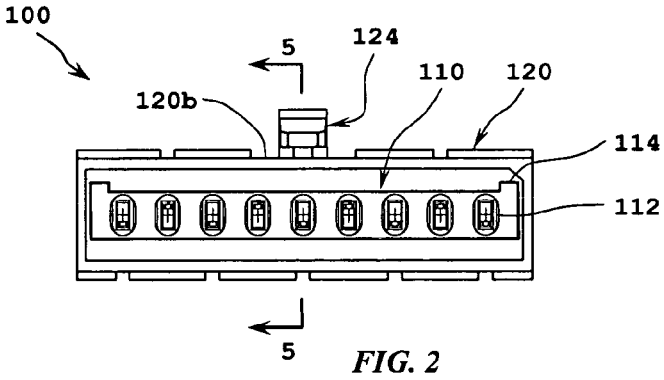
FIG. 2 is a front elevational view of the connector assembly of FIG. 1.
Figure 4:
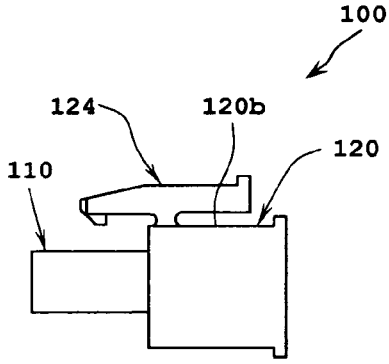
FIG. 4 is a side elevational view of the connector assembly of FIGS. 1-3.

Embodiments of the presently disclosed connector and header assemblies will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring initially to FIGS. 1-6, a connector assembly, according to an embodiment of the present disclosure, is generally designated as 100. Connector assembly 100 includes a front housing 110, a rear housing 120 configured and dimensioned for operative engagement with front housing 110, and a plurality of contacts 130 operatively supported between front housing 110 and rear housing 120. Desirably, contacts 130 are tuning fork-type contacts (but not limited to tuning fork-type contacts), including an integral wire trap arm 130*a* (see FIGS. 5 and 6). Wire trap arm 130*a* of tuning fork-type contacts function to terminate pre-stripped wires to rear housing 120 with just a "poke-in" or insertion contact connection.

Rear housing 120 includes a plurality of passages 122 formed in a rear surface 120*a* thereof. Desirably, passages 122 are arranged in an upper row 122*a* and a lower row 122*b*. While nine total passages 122 are shown, it is contemplated and within the present disclosure that any number of passages 122 may be provided. Desirably, each passage 122 and contact 130 defines a push-in-type wire termination for terminating a respective wire $W_1$-$W_9$ of FIG. 1. Desirably, but not necessary, each wire $W_1$-$W_9$ includes a distinctive outer coating or insulation which may be visually identifiable. For example, each wire $W_1$-$W_9$ may be colored differently or have distinctive color markings or the like associated therewith. This coating or insulation is removed to a predetermined length for termination.

Front housing 110 includes a plurality of channels 112 arranged to be in operative registration with each passage 122 of rear housing 120 when front housing 110 and rear housing 120 are connected to one another. Front housing 110 further includes at least one polarization member 114 formed on a surface thereof for ensuring proper orientation of connector assembly 100 when being plugged into and/or mated with a header assembly 300 or complementary assembly. The polarization member 114 ensures that connector assembly 100 is in a proper orientation for mating with header assembly 300 or complementary assembly so that the proper electrical connections between connector assembly 100 and header assembly 300 are established.

Connector assembly 100 further includes a latch arm 124 operatively connected to an upper surface 120*b* of rear housing 120. In use, latch arm 124 desirably mates with and/or interlocks with corresponding detents 316 provided on header assembly 300 (see FIGS. 10-12). Latch arm 124 enables connector assembly 100 to be secured to header assembly 300 without the need for screws or the like to ensure that connector assembly 100 does not become dislodged or disconnected from header assembly 300 or complementary assembly.

Desirably, front and rear housings 110, 120, are fabricated from a thermoplastic type material. Meanwhile, contacts 130 are desirably fabricated from suitable conductive material such as, for example and not limited to, phosphor bronze and/or brass, and are preferably coated with tin over nickel plating. Contacts 130 may be fabricated from any suitable conductive material known in the industry.

Connector assembly 100 includes a visual coding system "V" provided on rear surface 120*a* of rear housing 120. Desirably, the visual coding system is applied on a label 140 or the like which may be adhered to or otherwise affixed to rear surface 120*a* of rear housing 120. While visual coding system "V" is shown and described as being placed/applied on label 140, it is envisioned and within the scope of the present disclosure for visual coding system "V" to be applied directly onto rear surface 120*a* of rear housing 120. It is further envisioned that visual coding system "V" may be placed anywhere on and/or in front and/or rear housing 110, 120, respectively. Any coding, known in the industry, may be applied to connector 100.

Visual coding system "V" includes a plurality of discrete identifiable and/or recognizable indicia corresponding to each wire which is to be connected or terminated to connector assembly 100. Desirably, each passage 122 includes a unique indicia associated therewith. Preferably, each specific indicium corresponds to an identical or substantially similar color and/or pattern provided with each wire to be terminated at connector assembly 100.

In the embodiment shown in FIGS. 1-6, visual coding system "V" includes nine (9) unique and/or discrete indicia 142*a*-142*i* corresponding, one each, to passages 122. Desirably, each indicia 142*a*-142*i* is provided on label 140 which is affixed to rear surface 120*a* of rear housing 120. It is envisioned that label 140 is affixed to rear surface 120*a* of rear housing 120 at a location between the upper row 122*a* of passages 122 and the lower row 122*b* of passages 122.

Figure 3:
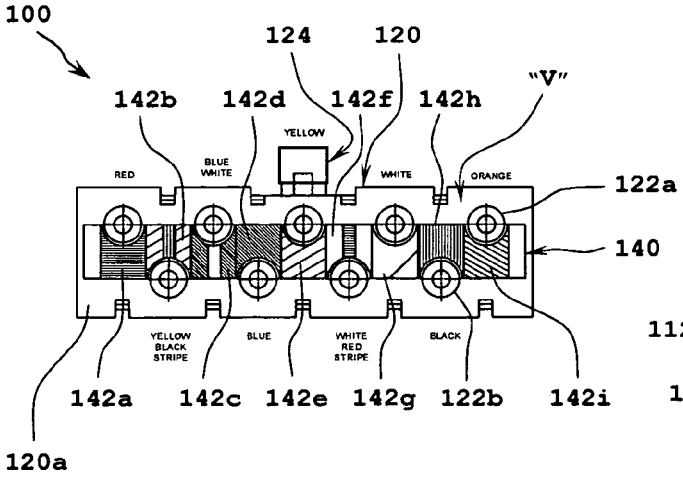
FIG. 3 is a rear elevational view of the connector assembly of FIGS. 1 and 2.
Figure 5:
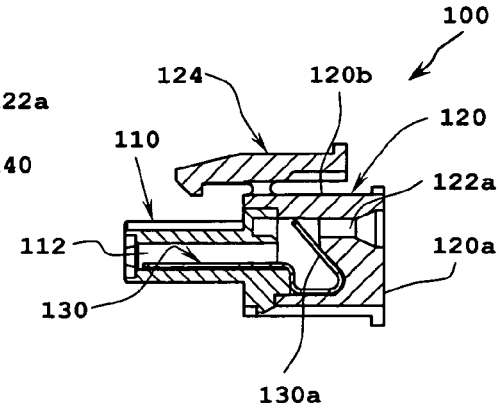
FIG. 5 is a cross-sectional view as taken through 5-5 of the connector assembly of FIGS. 1-4.
Figure 6:
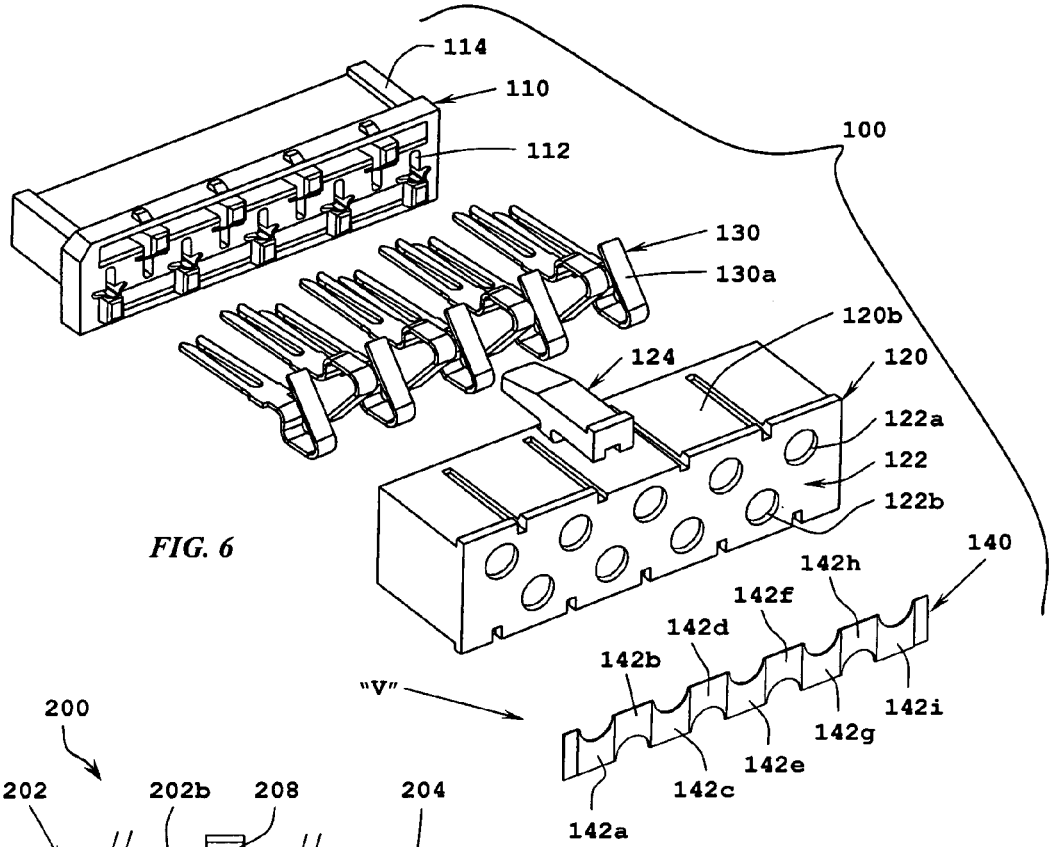
FIG. 6 is a perspective view, with parts separated, of the connector assembly of FIGS. 1-5.

In one embodiment, as seen in FIG. 3, indicia 142*a*-142*i* of label 140 may be represented as follows: indicia 142*a* may be a solid red patch; indicia 142*b* may be a solid yellow patch with a black stripe; indicia 142*c* may be a solid blue patch with a white stripe; indicia 142*d* may be a solid blue patch; indicia 142*e* may be a solid yellow patch; indicia 142*f* may be a solid white patch with a red stripe; indicia 142*g* may be a solid white patch; indicia 142*h* may be a solid black patch; and indicia 142*i* may be a solid orange patch.

It is envisioned that the color coding for each indicia 142*a*-142*i* of the label 140 of visual coding system "V" may correspond to the particular colors of the outer coating of wires $W_1$-$W_9$ which are to be terminated at connector assembly 100. For example, if wire $W_1$ has a red outer coating (the red outer coating not being shown), then wire $W_1$ is to be terminated in the passage 122 having the solid red patch indicia 142*a* associated therewith. In another example, if wire $W_6$ has a white outer coating with a red stripe (the outer coating not being shown), then wire $W_6$ is to be terminated in the passage 122 having the solid white patch with red stripe indicia 142*f* associated therewith. In other words, each wire $W_1$-$W_9$ is matched to a corresponding passage 122 of connector assembly 100 based upon the particular distinctive color of wire $W_1$-$W_9$ and based upon the particular distinctive indicia 142*a*-142*i* associated with each passage 122.

Figure 7:
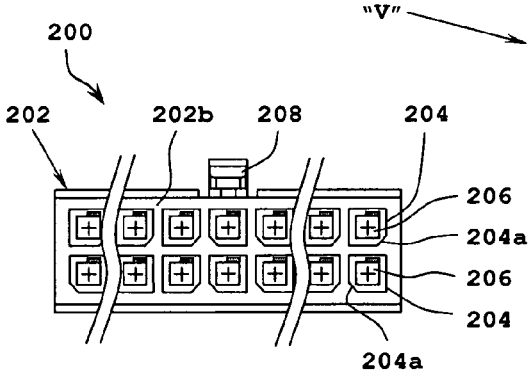
FIG. 7 (Prior Art)
FIG. 7 is a front elevational view of a prior art plug receptacle housing.
Figure 8:
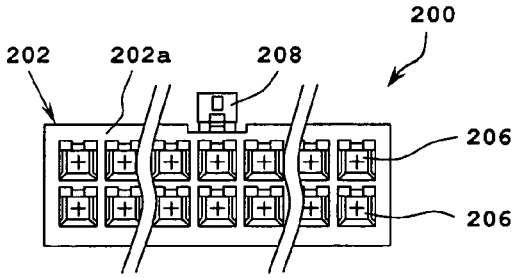
FIG. 8 (Prior Art)
FIG. 8 is a rear elevational view of the prior art plug receptacle housing of FIG. 7.
Figure 9:
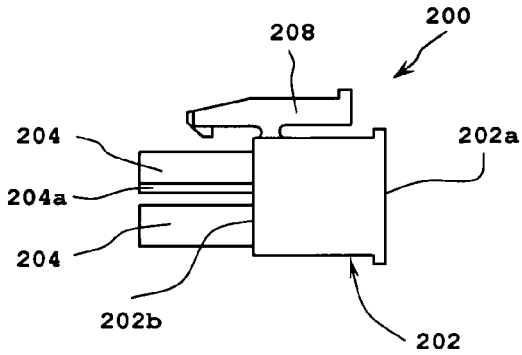
FIG. 9 (Prior Art)
FIG. 9 is a side elevational view of the prior art plug receptacle housing of FIGS. 7 and 8.

Turning now to FIGS. 7-9, a prior art plug receptacle housing is generally designated as 200. Plug receptacle housing 200 includes a main body portion 202 defining a rear surface 202*a*, and a plurality of contact silos 204 extending from a front surface 202*b* of main body portion 202. Plug receptacle housing 200 includes contact receiving passages 206 extending from rear surface 202*a* of main body portion 202 forward through the contact silos 204. The contact silos 204 may be provided with polarization features 204*a* is desired. Contact silos 204 are designed to be received within a second set of receptacles 320 of in header assembly 300

Plug receptacle housing 200 further includes a latch arm 208 which extends forward from main body portion 202. In use, latch arm 208 desirably mates with and/or interlocks with a corresponding detent 326 provided on header assembly 300 (see FIGS. 10-12). Latch arm 208 enables plug receptacle housing 200 to be secured to header assembly 300 without the need for screws or the like to ensure that plug receptacle housing 200 does not become dislodged or disconnected from header assembly 300.

Plug receptacle housing 200 may include anywhere from two to twenty- four contact silos 204 extending from main body portion 202, wherein the contact silos 204 are arranged in a pair of rows.

Connectors using plug receptacle housings 200 are of the type sold under the tradename MATE-N-LOK® by AMP Incorporated.

Figure 10:
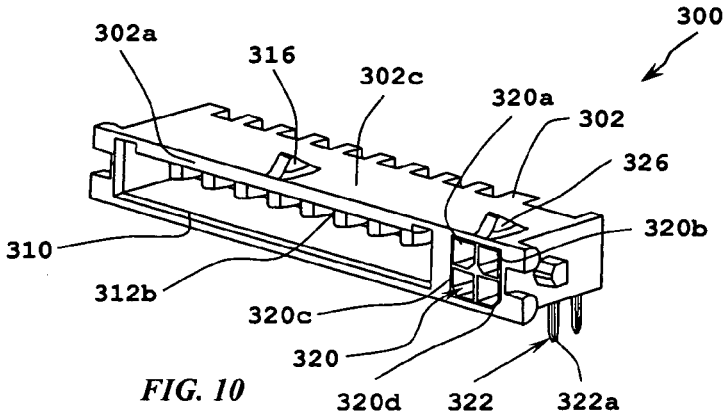
FIG. 10 is a front perspective view of a header assembly according to an embodiment of the present disclosure for simultaneously accommodating the connector assembly of FIGS. 1-6 and the plug receptacle housing of FIGS. 7-9.
Figure 11:
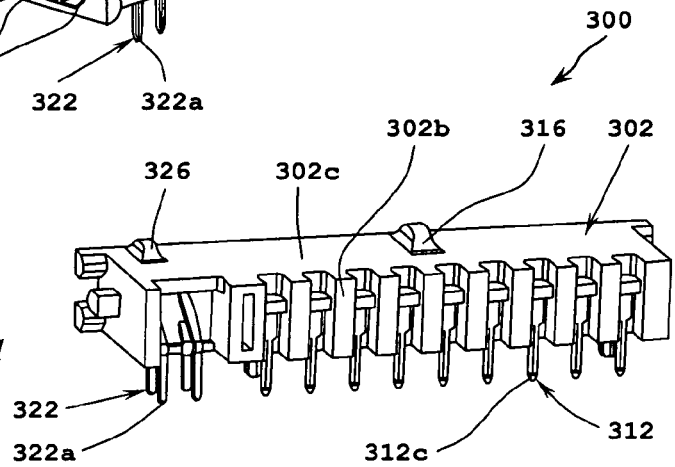
FIG. 11 is a rear perspective view of the header assembly of FIG. 10.
Figure 12:
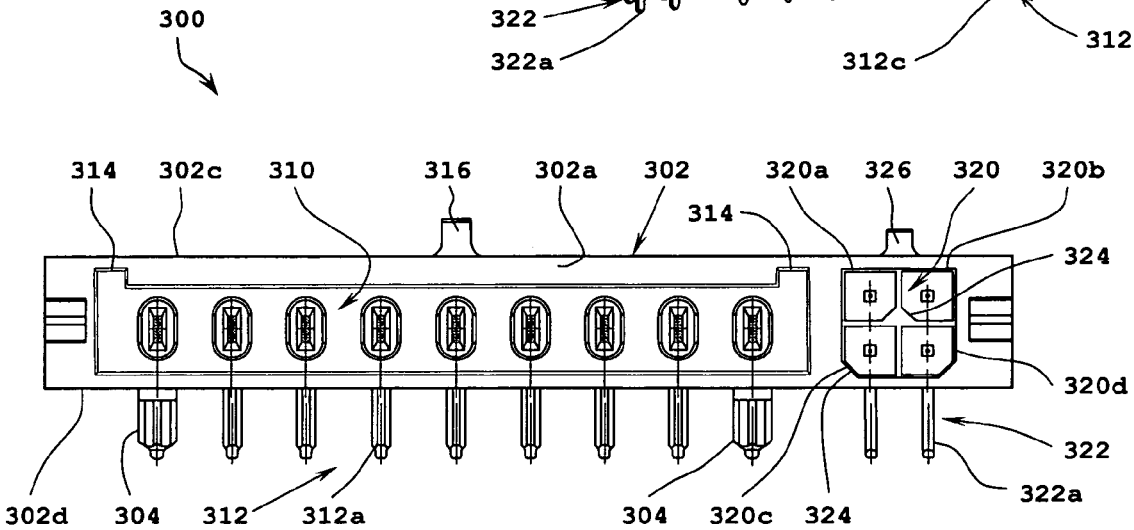
FIG. 12 is a front elevational view of the header assembly of FIGS. 10 and 11.

Turning now to FIGS. 10-12, a header assembly, according to an embodiment of the present disclosure, is generally designated as 300. Header assembly 300 is configured and dimensioned to simultaneously selectively receive and mate with connector assembly 100 and/or plug receptacle housing 200.

Header assembly 300 includes a body portion or housing 302 defining a first receptacle 310 and a second receptacle 320 formed in a front surface 302*a* thereof. While first receptacle 310 and second receptacle 320 are shown as being located adjacent to one another in FIGS. 10 and 12, it is envisioned and within the scope of the present disclosure for first receptacle 310 and second receptacle 320 to be located in any relative position to one another without departing from the scope and spirit of the present disclosure.

Desirably, first receptacle 310 is configured and dimensioned to selectively receive and/or mate with connector assembly 100 and establish an electrical connection therewith. Additionally, second receptacle 320 is configured and dimensioned to selectively receive and/or mate with plug receptacle housing 200 and establish an electrical connection therewith.

As seen in FIGS. 10-12, first receptacle 310 includes a plurality of electrical contact leads 312 operatively associated therewith and arranged to electrically engage contacts 130 of connector housing 100. Electrical contact leads 312 include a first end (312*b*) for electrical connection with contacts 130 of connector housing 100, and a second end 312*a* extending from a rear surface 302*b* of housing 302 for electrical connection with a printed circuit board "P" (see FIG. 13).

First receptacle 310 of header assembly 300 is provided with at least one polarization element 314 which complements polarization element 114 of connector assembly 100. Header assembly 300 further includes a first detent 316 extending from an upper surface 302*c* of housing 302. First detent 316 is positioned on housing 302 at a location so as to selectively engage latch arm 124 (see FIGS. 1-6) of connector assembly 100.

As seen in FIGS. 10-12, second receptacle 320 includes at least two, preferably a plurality of individual receptacles, each configured and dimensioned to selectively receive a corresponding contact silo 204 of plug receptacle housing 200. In the embodiment shown in FIGS. 10-12, second receptacle 320 includes four (4) individual receptacles 320*a*-320*d*. While four (4) individual receptacles 320*a*-320*d* are shown and described, it is envisioned and within the scope of the present disclosure that any number of individual receptacles may be provided, such as for example, anywhere from two (2) individual receptacles to at least twenty-four (24) individual receptacles, without departing from the spirit and the scope of the present disclosure. Desirably, the number of individual receptacles corresponds to the number of contact silos 204 of plug receptacle housing 200 intended to be mated to header assembly 300.

Header assembly 300 further includes a plurality of electrical contact leads 322 operatively associated with each individual receptacle 320*a*-320*d*. Electrical contact leads 322 are desirably arranged to electrically engage electrical contacts (not shown) of plug receptacle housing 200. Electrical contact leads 322 include a first end (not shown) for electrical connection with the electrical contacts (not shown) of plug receptacle housing 200, and a second end 322*a* extending from rear surface 302*b* of housing 302 for electrical connection with printed circuit board "P" (see FIG. 13).

Each individual receptacle of the second receptacle 320 of header assembly 300 is provided with at least one polarization element 324 which complements polarization element 204*a* of plug receptacle housing 200. Header assembly 300 further includes a second detent 326 extending from upper surface 302*c* of housing 302. Second detent 326 is positioned on housing 302 at a location so as to selectively engage latch arm 208 (see FIGS. 7-9) of plug receptacle housing 200.

First and second detents 316, 326 function to selectively engage latch arm 124 of connector assembly 100 and latch arm 208 of plug receptacle housing 200, respectively. As mentioned above, detents 316, 326 and latch arms 124 and 208 function to operatively engage one another and respectfully prevent connector assembly 100 and/or plug receptacle housing 200 from becoming dislodged and/or disconnected from header assembly 300.

While header assembly 300 is shown as having a second receptacle 320 configured and dimensioned to selectively engage and/or mate with a plug receptacle housing 200 including four (4) contact silos 204 arranging in two rows of two, it is envisioned and within the scope of the present disclosure for header assembly 300 to include a second receptacle 320 configured and dimensioned to receive a plug receptacle housing having any number of contact silos 204 without departing from the scope and or spirit of the present disclosure.

Desirably, second receptacle 320 of header assembly 300 is configured and dimensioned to selectively engage and/or mate with plug receptacle housings 200 of the type sold under the tradename MATE-N-LOK®.

As seen in FIG. 12, header assembly 300 includes at least one, preferably a pair, of hold-downs 304 extending from a bottom surface 302*d* thereof. Hold-downs 304 are configured and dimensioned to press-fit connect header assembly 300 to printed circuit board "P".

Figure 13:
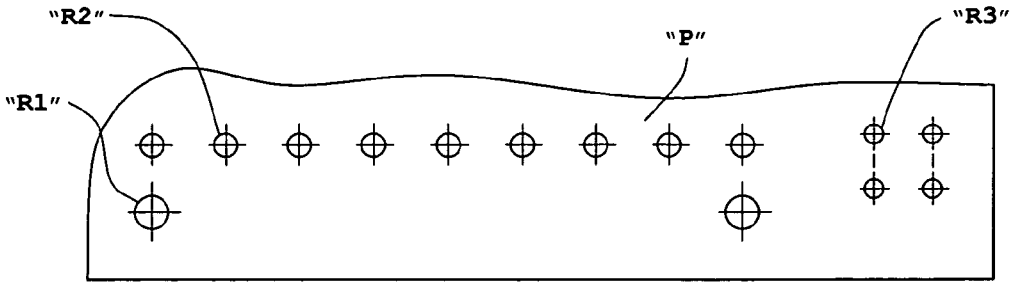
FIG. 13 is a plan view of a printed circuit board illustrating a layout for receiving hold-downs and contact leads extending from the header assembly of FIGS. 10-12; 12.
Figure 14:
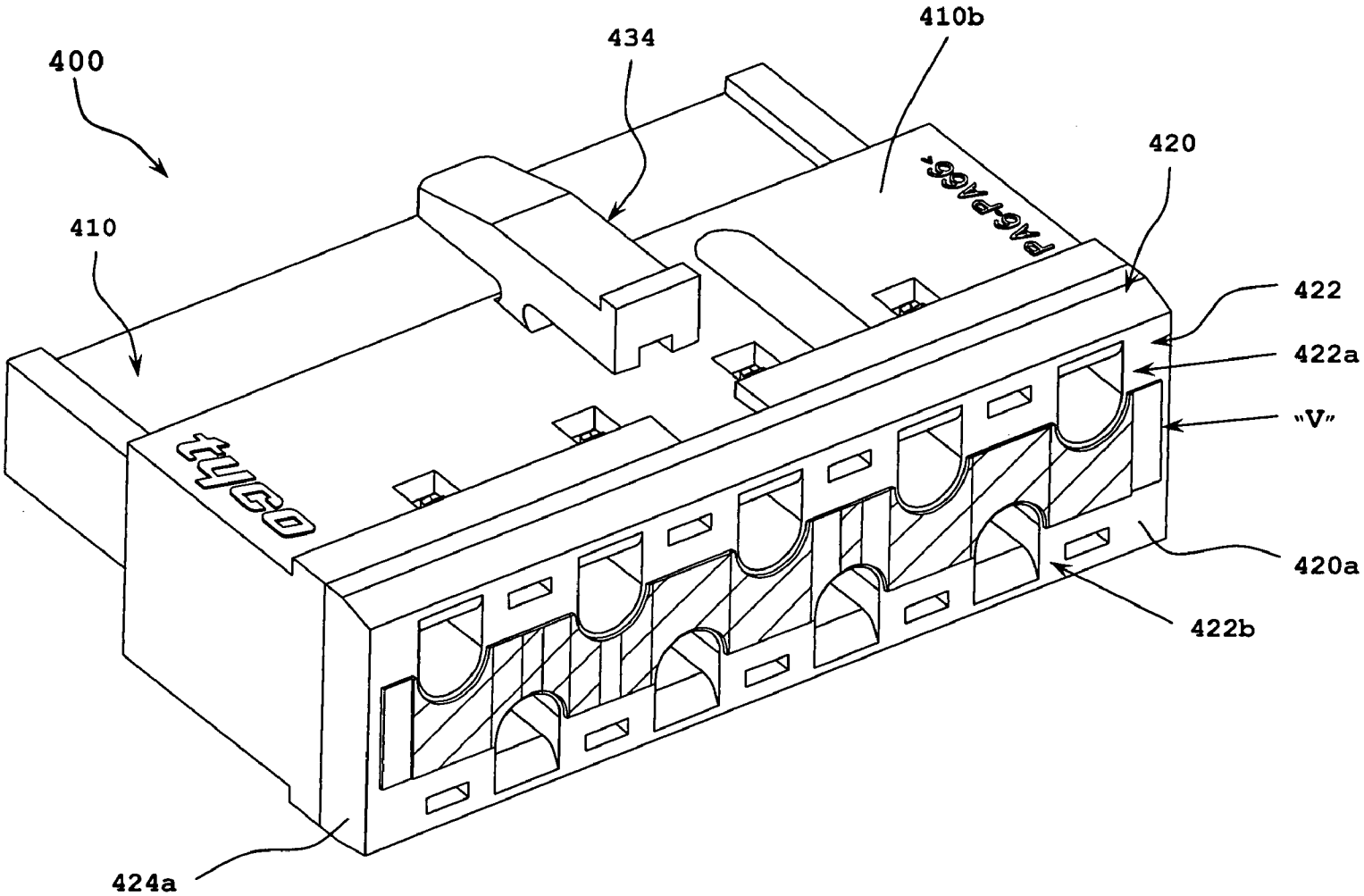
FIG. 14 is a perspective view of a connector assembly according to another embodiment of the present disclosure.

As seen in FIG. 13, a preferred layout for a printed circuit board "P" for operatively engaging with header assembly 300 is shown. Printed circuit board "P" includes at least one, preferably a pair of, mounting apertures "R1" configured and dimensioned to receive hold-downs 304 of header assembly 300. Printed circuit board "P" further includes a row of apertures "R2" formed therein for receiving and electrically engaging the second end 312*a* of electrical contact leads 312 extending from first receptacle 310. Printed circuit board "P" additionally includes a set of apertures "R3" configured and dimensioned to receive and electrically engage the second end 322*a* of electrical contacts 322 extending from second receptacle 320.

As shown in FIGS. 10-12, header assembly 300 is configured and adapted to establish a wire-to-board connection. However, although header assembly 300 is shown and described for use in establishing a wire-to-board connection, as is know in the art and as is contemplated herein, header assembly 300 may be configured and adapted to establish a wire-to-wire connection.

Referring now to FIGS. 14-19, a connector assembly, according to another embodiment of the present disclosure, is generally designated as 400. Connector assembly 400 is substantially similar to connector assembly 100 and thus will only be described in detail to the extent necessary to identify differences in construction and operation.

Figure 18:
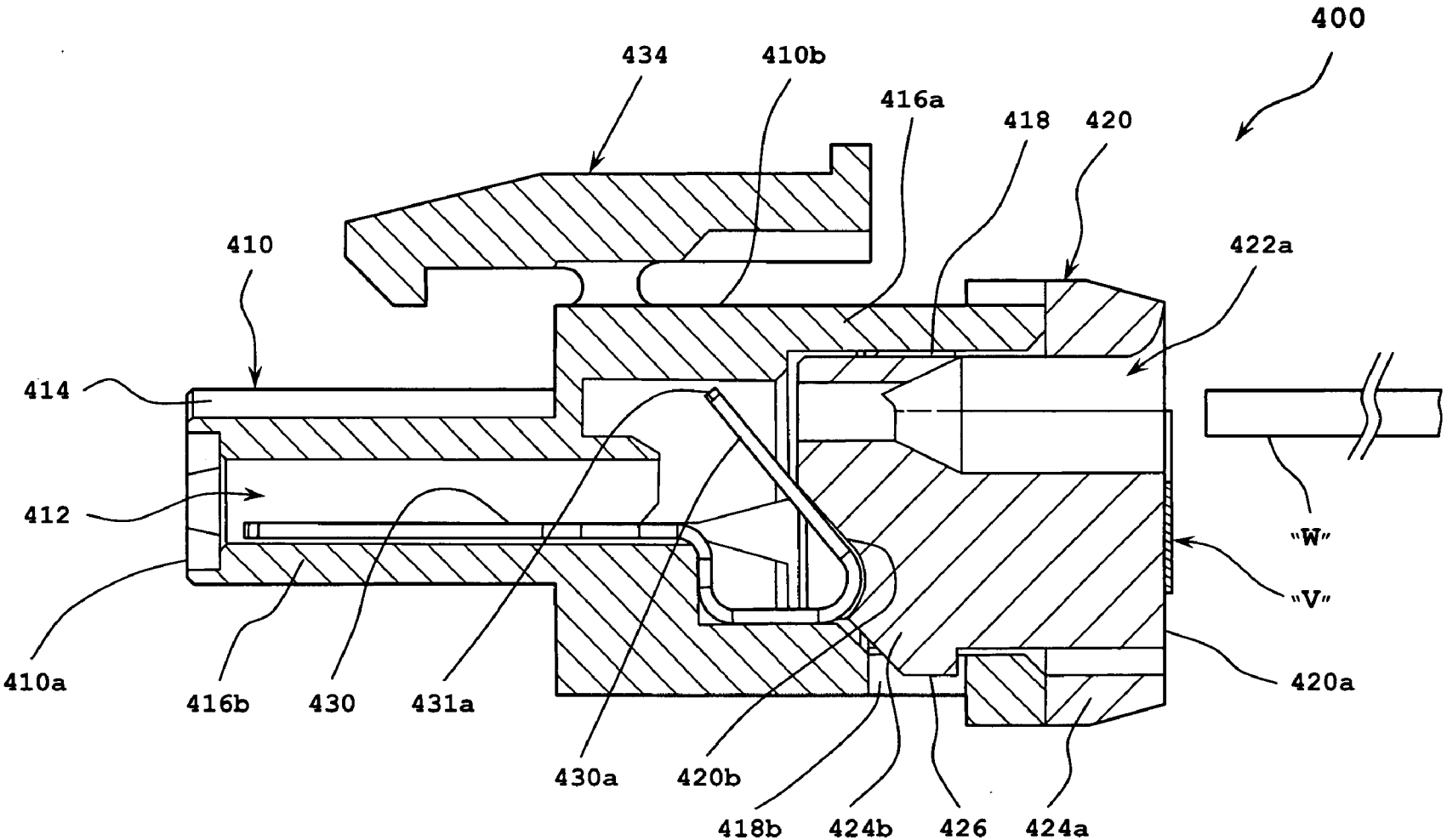
FIG. 18 is a cross-sectional view as taken through 18-18 of FIG. 15 of the connector assembly of FIGS. 14-17, illustrating the insertion and connection of a wire thereto.
Figure 19:
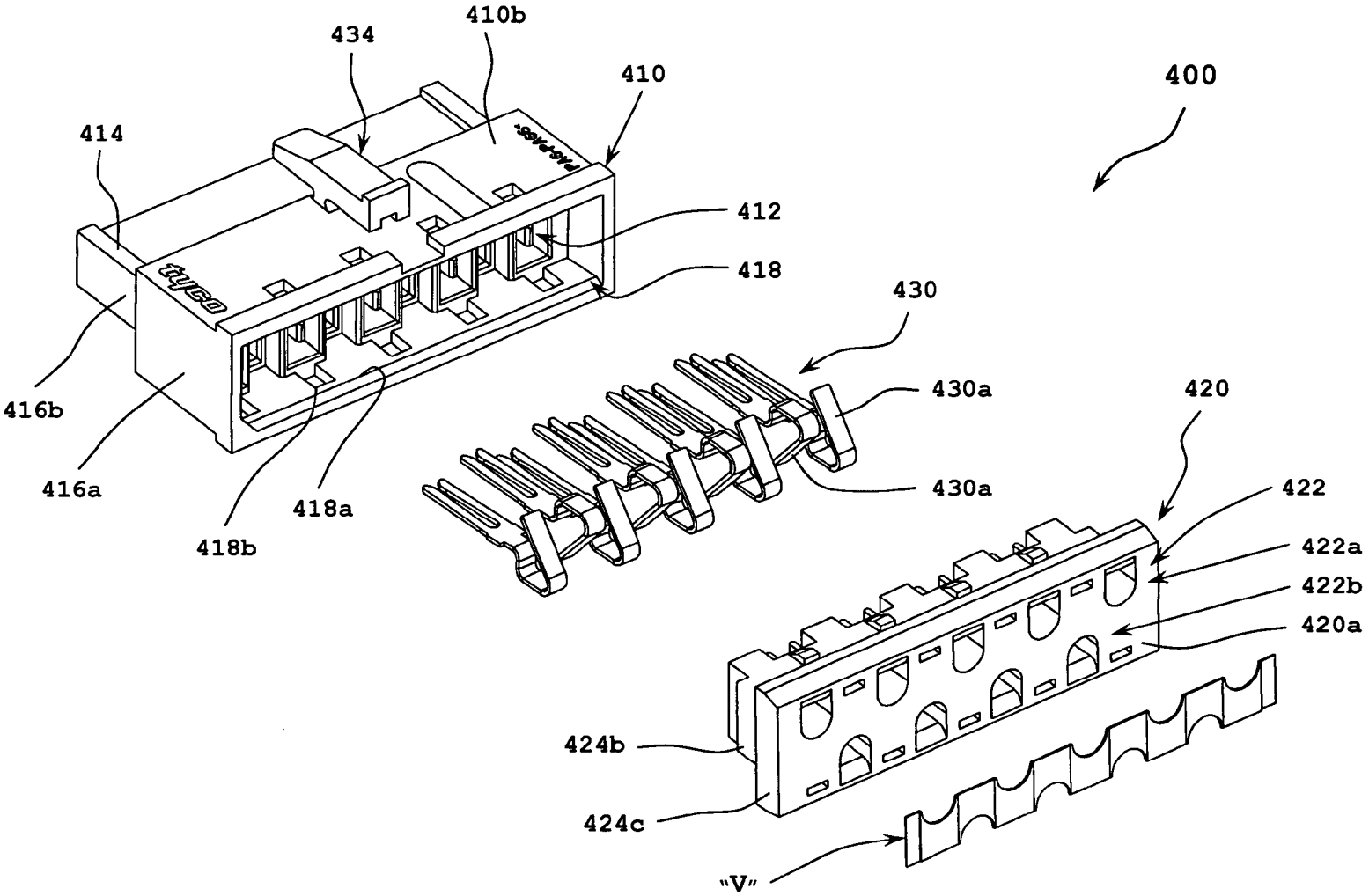
FIG. 19 a perspective view, with parts separated, of the connector assembly of FIGS. 14-18.

Connector assembly 400 includes a front housing 410, a rear housing 420 configured and dimensioned for operative engagement with front housing 410, and a plurality of contacts 430 (see FIGS. 18 and 19) operatively supported between front housing 410 and rear housing 420. Desirably, as seen in FIGS. 18 and 19, contacts 430 are tuning fork-type contacts, including an integral wire trap arm 430*a*. Wire trap arm 430*a* of tuning fork-type contacts function to terminate pre-stripped wires to rear housing 420 with just a "poke-in" or insertion contact connection.

Figure 18A:
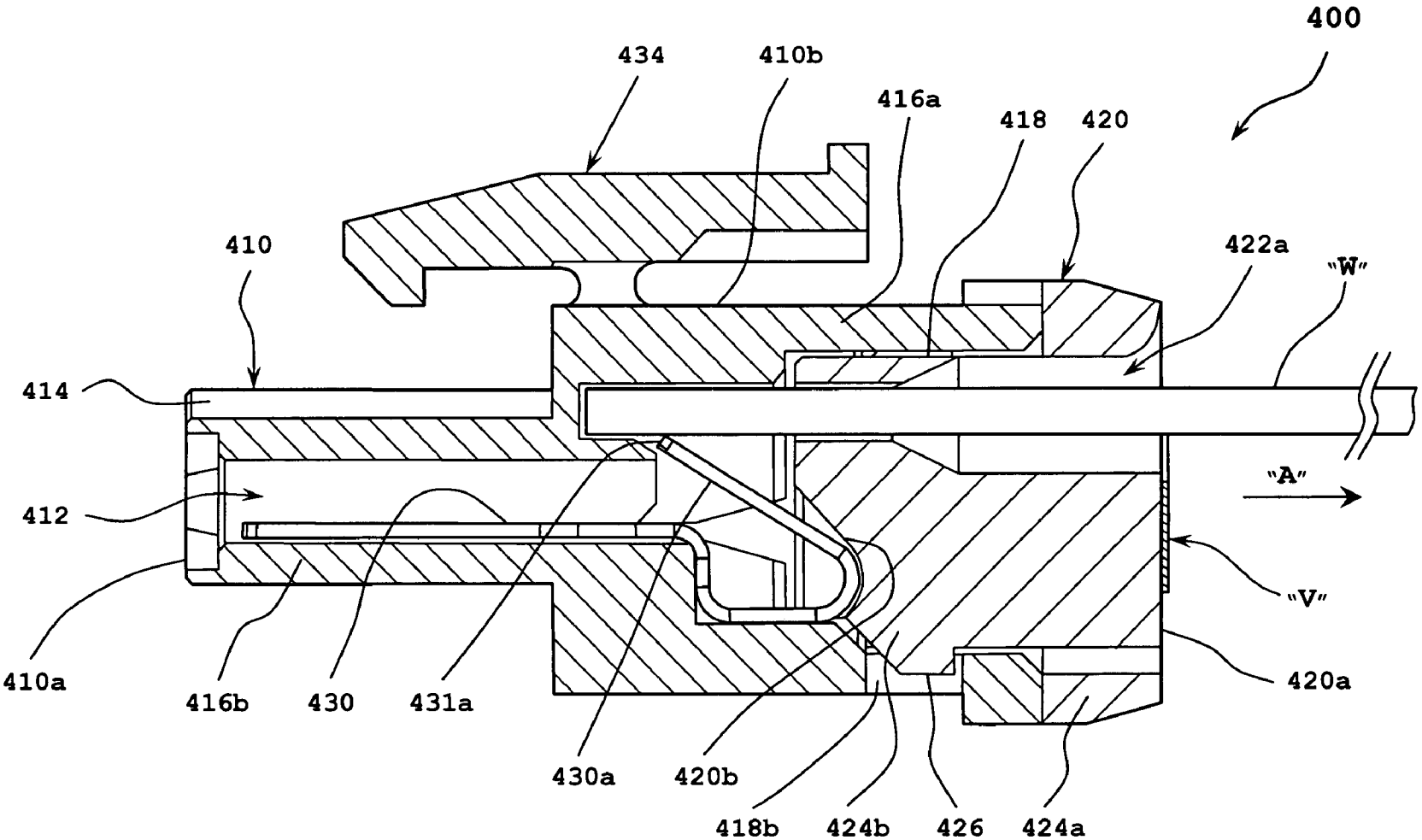
FIG. 18A is a further cross-sectional view as taken through 18-18 of FIG. 15 of connector assembly of FIGS. 14-17, illustrating the wire inserted and connected thereto.

In particular, as seen in FIGS. 18 and 18A, each wire trap arm 430*a* is angled in a direction away from rear surface 420*a* of rear housing 420. Rear housing 420 includes a distal, angled surface 420*b* which defines a maximum angle at which wire trap arm 430*a* may be oriented. Also, angled surface 420*b* of rear housing 420 inhibits wire trap arm 430*a* from deflecting to an orientation directed toward rear surface 420*a* of rear housing 420.

As seen in FIGS. 18 and 18A, when a stripped end of a wire "W" is inserted into a passage of upper row 422*a* (i.e., "poked-in"), wire "W" causes wire trap arm 430*a* to deflect downward or toward a distal surface 410*a* of front housing 410, thus allowing for a distal end of wire "W" to extend beyond a tip 431*a* of wire trap arm 430*a*. The resiliency and/or bias of wire trap arm 430*a* results in distal tip 431*a* digging into an outer surface of wire "W" and trapping wire "W" in the passage of connector assembly 400. In this manner, if wire "W" were withdrawn in a direction away from connector assembly 400 (as indicated by arrow "A" of FIG. 18A), the resiliency and/or bias of wire trap arm 430*a* would further cause distal tip 431*a* thereof to dig into the outer surface of wire "W" and thus further tighten the connection.

As seen in FIGS. 14, 16, 18 and 19, rear housing 420 includes a plurality of passages 422 formed in a rear surface 420*a* thereof. Desirably, passages 422 are arranged in an upper row 422*a* (including five passages) and a lower row 422*b* (including four passages). While nine total passages 422 are shown, it is contemplated and within the present disclosure that any number of passages 422 may be provided. Each passage 422 has a substantially tombstone-like profile, e.g., having a flattened upper or lower end and an arcuate or rounded opposite end. Desirably, each passage 422 and contact 430 defines a push-in-type wire termination for terminating a respective wire $W_1$-$W_9$ (see FIG. 1).

As described above, each wire $W_1$-$W_9$ may include a distinctive outer coating or insulation which may be visually identifiable. For example, each wire $W_1$-$W_9$ may be colored differently or have distinctive color markings or the like associated therewith. This coating is removed to a predetermined length for termination.

As best seen in FIGS. 18 and 19, rear housing 420 includes a front end portion 424*a* having a first dimensional height, and a rear end portion 424*b*, extending from front end portion 424*a*, having a second dimensional height which is less than the first dimensional height of front end portion 424*a*. Rear end portion 424*b* of rear housing 420 includes a tab or the like 426 configured and adapted to snap-fit engage a complementary recess or the like formed in front housing 410. In this manner connector assembly 400 is a separable-type interface, wherein rear housing 420 may be separated from front housing 410.

Figure 15:
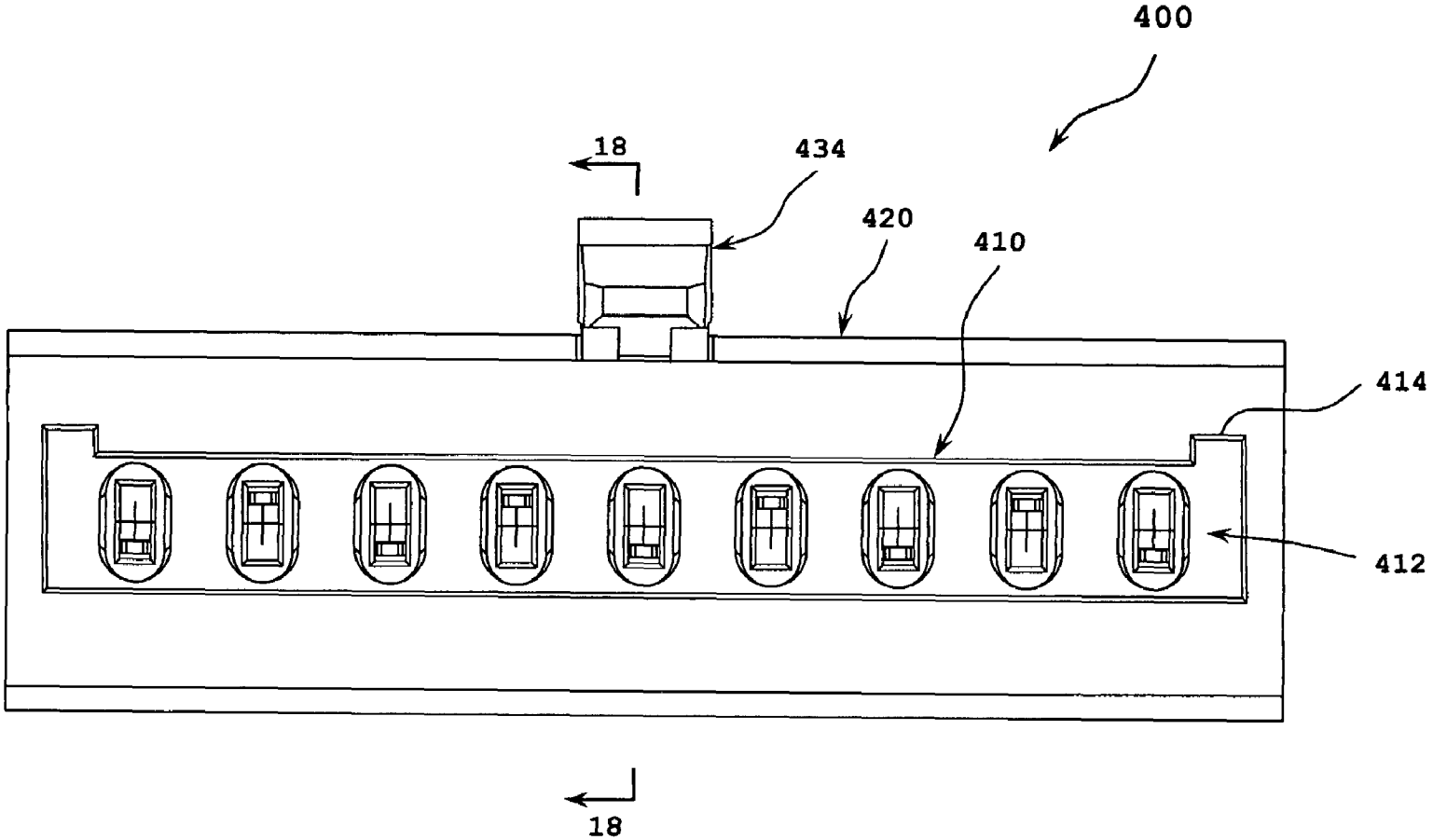
FIG. 15 is a front elevational view of the connector assembly of FIG. 14.
Figure 16:
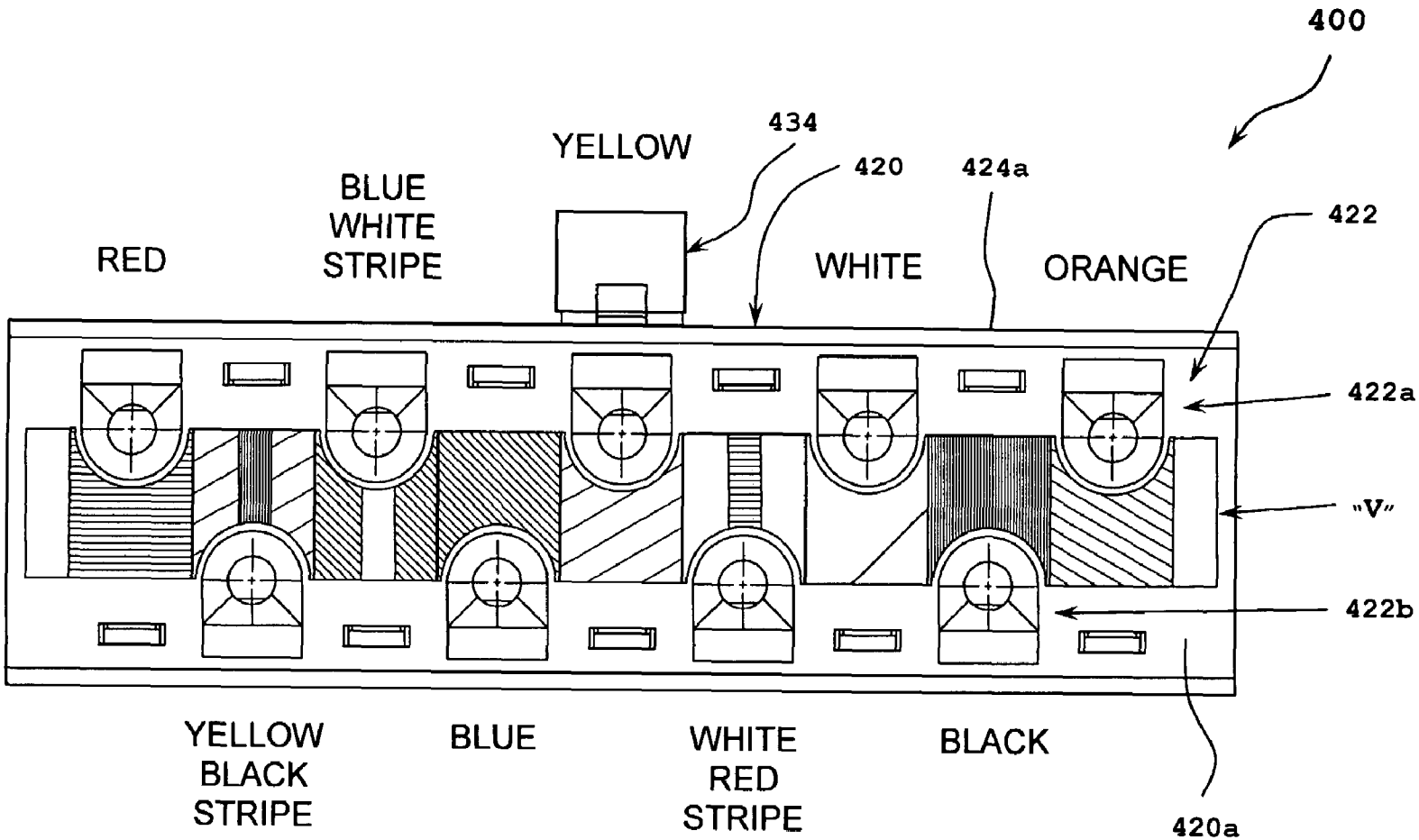
FIG. 16 is a rear elevational view of the connector assembly of FIGS. 14 and 15.
Figure 17:
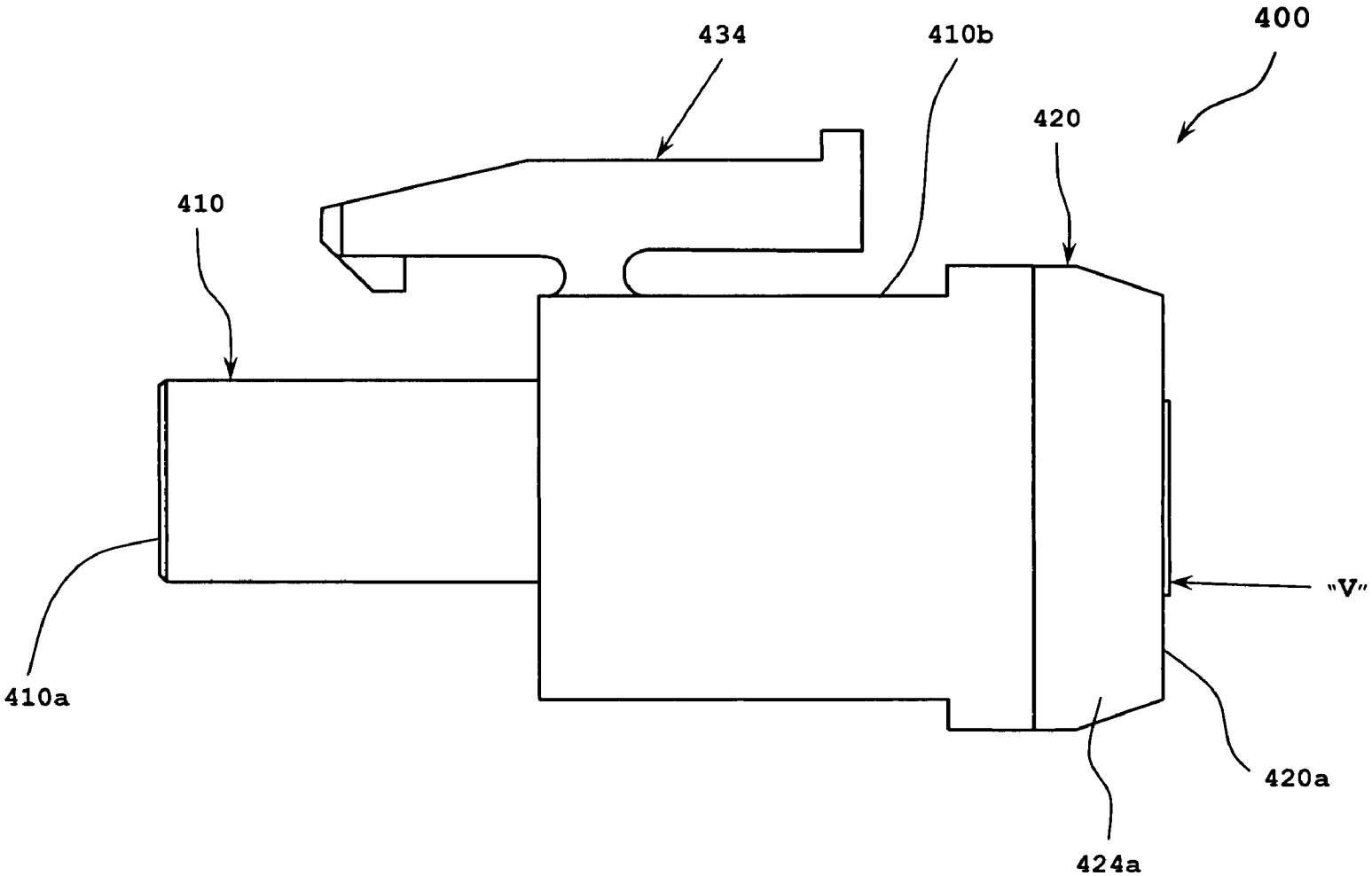
FIG. 17 is a side elevational view of the connector assembly of FIGS. 14-16.

As seen in FIGS. 15, 17 and 19, front housing 410 includes a plurality of channels 412 arranged to be in operative registration with each passage 422 of rear housing 420 when front housing 410 and rear housing 420 are connected to one another. Front housing 410 further includes at least one polarization member 414 formed on a surface thereof for ensuring proper orientation of connector assembly 400 when being plugged into and/or mated with a header assembly 300 or a complementary connector assembly. The polarization member 414 ensures that connector assembly 400 is in a proper orientation for mating with header assembly 300 so that the proper electrical connections between connector assembly 400 and header assembly 300 are established.

As best seen in FIGS. 18 and 19, front housing 410 includes a front end portion 416*a* having a first dimensional height, and a rear end portion 416*b*, extending from front end portion 416*a*, having a second dimensional height which is less than the first dimensional height of front end portion 416*a*. Front end portion 416*a* of front housing 410 defines a cavity 418 formed in a front face thereof and configured and dimensioned to receive rear end portion 424*b* of rear end housing 420 therein. A surface 418*a* of front end portion 416*a* of front housing 410, defining cavity 418, includes at least one recess, opening or window 418*b* formed therein for selectively engaging tab 426 of rear end portion 424*b* of rear housing 420 when rear housing 420 is operatively coupled with front housing 410.

Connector assembly 400 further includes a latch arm 434 operatively connected to an upper surface 410*b* of front housing 410. In use, latch arm 434 mates with and/or interlocks with corresponding detents 316 provided on header assembly 300 (see FIGS. 10-12). Latch arm 434 enables connector assembly 400 to be secured to header assembly 300 without the need for screws or the like to ensure that connector assembly 400 does not become dislodged or disconnected from header assembly 300.

Connector assembly 400 further includes a visual coding system "V" provided on rear surface 420*a* of rear housing 420. Visual coding system "V" of connector assembly 400 is substantially similar to the visual coding system of connector assembly 100 and thus will not be discussed in great detail herein below.

Visual coding system "V" of connector assembly 400 includes a plurality of discrete identifiable and/or recognizable indicia corresponding to each wire which is to be connected or terminated to connector assembly 400. Desirably, each passage 422 of connector assembly 400 includes a unique indicia associated therewith. Preferably, each specific indicium corresponds to an identical or substantially similar color and/or pattern provided with each wire to be terminated at connector assembly 400.

In the embodiment shown in FIGS. 14-19, visual coding system "V" includes nine (9) unique and/or discrete indicia corresponding, one each, to passages 422 of connector assembly 400. Each indicia of visual coding system "V" may be provided on a label which is affixed to rear surface 420*a* of rear housing 420.

It is to be understood that the foregoing description is merely a disclosure of particular embodiments and is in no way intended to limit the scope of the invention. Other possible modifications will be apparent to those skilled in the art and all modifications will be apparent to those in the art and all modifications are to be defined by the following claims.

What is claimed is:

1. A connector assembly for terminating a wire or a plurality of discrete wires and for selective electrical interconnection with a header assembly, the connector assembly comprising:

a front housing defining at least one channel therein and including at least one passage to accept a separable contact lead, the front housing including a front end portion and a rear end portion, the front end portion of the front housing defines a cavity formed in a front face thereof;

a rear housing selectively operatively connectable to the front housing, the rear housing including at least one passage formed therein and in operative association with a respective channel of the front housing, each passage terminating a respective discrete wire, the rear housing including a front end portion and a rear end portion, the rear end portion of the rear housing being configured and dimensioned for insertion into the cavity of the front housing; and at least one contact disposed at least partially within each channel of the front housing and each corresponding passage of the rear housing, wherein each contact is configured and adapted to define a poke-in connection, wherein a portion of the respective discrete wire extends through the rear housing and into the front housing.

2. The connector assembly according to claim 1, wherein each contact includes a wire trap arm having a distal end extending into the respective passage of the rear housing.

3. The connector assembly according to claim 2, wherein each wire trap arm is angled away from a rear surface of the rear housing.

4. The connector assembly according to claim 3, wherein each wire trap arm is deflectable towards a distal surface of the front housing.

5. The connector assembly according to claim 3, wherein each wire trap arm is deflectable upon insertion of a wire into the respective passage of the rear housing, and wherein withdrawal of said wire from the respective passage results in a distal tip of the wire trap arm digging into the wire.

6. The connector assembly according to claim 3, wherein each wire trap arm is deflectable from a first position in which the distal end thereof extends into the respective passage of the rear housing, and a second position in which said wire trap arm is deflected toward a distal surface of the front housing.

7. The connector assembly according to claim 1, further comprising a visual coding system provided on a surface of at least one of the front housing and the rear housing, the visual coding system including a unique indicia for each passage of the rear housing.

8. The connector assembly according to claim 7, wherein the indicia is a set of color codes.

9. The connector assembly according to claim 7, wherein the visual coding system is provided on a rear surface of the rear housing.

10. The connector assembly according to claim 9, wherein the visual coding system includes a label including all of the indicia produced thereon, wherein the label is affixed to the rear surface of the rear housing.

11. The connector assembly according to claim 10, wherein the passages provided in the rear housing are arranged into an upper row of passages and a lower row of passages.

12. The connector assembly according to claim 11, wherein the label is affixed between the upper row of passages and the lower row of passages.

13. The connector assembly according to claim 1, further comprising a latch arm operatively connected to an upper surface of the rear housing, wherein the latch arm is configured to operatively engage a detent provided on a surface of a header assembly.

14. The connector assembly according to claim 13, wherein the front housing includes at least one polarization member configured and dimensioned to operatively engage a complementary polarization element provided in a receptacle of the header assembly.

15. The connector assembly according to claim 1, wherein each contact is a tuning fork-shaped contact to accept one of a blade and pin lead on one end thereof and wire trap arm on another end thereof.

16. The connector assembly according to claim 1, wherein the rear housing press-fit engages with the front housing.

17. The connector assembly according to claim 1, wherein the cavity formed in the front surface of the front housing has a first dimensional height, and the rear end portion of the rear housing has a second dimensional height that is less than the first dimensional height of the cavity.

18. The connector assembly according to claim 15, wherein the wire trap arm of each contact extends into at least one of a respective path of the passage of the rear housing and a respective path of the channel of the front housing.

19. The connector assembly according to claim 1, wherein each contact is captured between the front housing and the rear housing when the front and rear housings are coupled to one another.

20. The connector assembly according to claim 1, wherein the front housing and rear housing are fabricated from a thermoplastic material.

21. The connector assembly according to claim 1, wherein each contact is fabricated from a conductive material.

* * * * *